US012201259B2

(12) United States Patent
Shih et al.

(10) Patent No.: US 12,201,259 B2
(45) Date of Patent: Jan. 21, 2025

(54) SUCTION DEVICE AND SUCTION FORCE ADJUSTMENT METHOD THEREOF

(71) Applicant: Aspect Microsystems Corp., Taipei (TW)

(72) Inventors: Mingshun Shih, Taipei (TW); Jung-Fu Liao, Taipei (TW)

(73) Assignee: Aspect Microsystems Corp., Taipei (TW)

( * ) Notice: Subject to any disclaimer, the term of this patent is extended or adjusted under 35 U.S.C. 154(b) by 0 days.

(21) Appl. No.: 17/830,358

(22) Filed: Jun. 2, 2022

(65) Prior Publication Data

US 2022/0395155 A1 Dec. 15, 2022

(30) Foreign Application Priority Data

Jun. 9, 2021 (TW) ..... 110121028

(51) Int. Cl.
*A47L 9/28* (2006.01)

(52) U.S. Cl.
CPC ..... *A47L 9/2842* (2013.01); *A47L 9/2815* (2013.01); *A47L 9/2826* (2013.01); *A47L 2201/06* (2013.01)

(58) Field of Classification Search
CPC ..... A47L 9/2842; A47L 9/2815; A47L 9/2826
See application file for complete search history.

(56) References Cited

U.S. PATENT DOCUMENTS

| | | | | |
|---|---|---|---|---|
| 4,601,082 | A | 7/1986 | Kurz | |
| 4,680,827 | A | 7/1987 | Hummel | |
| 5,105,502 | A | 4/1992 | Takashima | |
| 5,815,884 | A | 10/1998 | Imamura et al. | |
| 2012/0012139 | A1* | 1/2012 | Soh | F16L 55/46 134/166 C |
| 2018/0055312 | A1* | 3/2018 | Jung | G06T 19/006 |
| 2019/0150683 | A1* | 5/2019 | Valentini | A47L 5/22 |

FOREIGN PATENT DOCUMENTS

| | | |
|---|---|---|
| CN | 1961802 | 5/2007 |
| CN | 103153149 | 6/2013 |
| CN | 105796008 | 7/2016 |
| CN | 109464071 | 3/2019 |
| CN | 112437626 | 3/2021 |
| DE | 102008026884 | 12/2009 |
| EP | 3787459 | 3/2021 |
| JP | H04122339 | 4/1992 |
| JP | 2003164401 | 6/2003 |
| JP | 2003164401 A * | 6/2003 |
| JP | 2012115604 | 6/2012 |
| TW | 201902408 | 1/2019 |

OTHER PUBLICATIONS

Machine translation: Tamura, T. (JP 2003164401) (Year: 2003).*
"Office Action of China Counterpart Application", issued on Dec. 22, 2023, p. 1-p. 7.
"Notice of allowance of China Counterpart Application", issued on May 23, 2024, p. 1-p. 4.

* cited by examiner

*Primary Examiner* — Natasha N Campbell
(74) *Attorney, Agent, or Firm* — JCIPRNET

(57) ABSTRACT

A suction device and a suction force adjustment method thereof are provided. An optical detection unit is disposed on a suction path of a suction pipe to detect an object flowing through the suction pipe. Physical features of the object are determined according to a sensing result of the optical detection unit. A suction force of a suction unit is regulated based on the physical features of the object.

7 Claims, 7 Drawing Sheets

SUCTION DEVICE AND SUCTION FORCE ADJUSTMENT METHOD THEREOF

CROSS-REFERENCE TO RELATED APPLICATION

This application claims the priority benefit of Taiwan application serial no. 110121028, filed on Jun. 9, 2021. The entirety of the above-mentioned patent application is hereby incorporated by reference herein and made a part of this specification.

BACKGROUND

Technical Field

The present disclosure relates to an electronic device, particularly to a suction device and a suction force adjustment method thereof.

Description of Related Art

As the technology continues to advance, vacuum cleaners and sweeping robots that automatically vacuum fine dirt and charge themselves have become quite a common view. However, the cleaning effects of these tools may not be ideal, as the suction force of the vacuum cleaner may be compromised by an environment of a high degree of dirtiness or the excessive accumulation of dust. Although sweeping the same area repeatedly is a way to improve the cleaning result, it still takes more time and power to complete the task.

SUMMARY

The disclosure provides a suction device and a suction force adjustment method thereof capable of effectively improving the suction efficiency of a suction device.

The suction device of the disclosure includes a suction pipe, a suction unit, an optical detection unit, and a control host. The suction unit is connected to the suction pipe and is adapted to provide a suction force in the suction pipe to suck an object. The optical detection unit is disposed on a suction path of the suction pipe and detects the object flowing through the suction pipe. The optical detection unit includes at least one linear light source and at least one sensor group. The linear light source provides a light curtain formed by multiple beams. The light curtain is located on the suction path, and the object passes through the light curtain along the suction path. The linear light source and the sensor group are disposed on both sides of the suction path, and the sensor group senses the beams uninterrupted by the object to generate a sensing signal. The control host is coupled to the suction unit, the linear light source, and the sensor group. The control host determines physical features of the object according to the sensing signal and regulates the suction force of the suction unit based on the physical features of the object.

In an embodiment of the disclosure, the control host further displays an image of the object according to the sensing signal.

In an embodiment of the disclosure, the physical features of the object include at least one of transparency, quantity, density, shape, and size of the object.

In an embodiment of the disclosure, the beams are visible light or invisible light, and the sensor group includes a visible light sensor or an invisible light sensor.

In an embodiment of the disclosure, the control host further adjusts operating parameters of the linear light source and the sensor group according to the suction force of the suction unit.

In an embodiment of the disclosure, the operating parameters of the linear light source and the sensor group include the frequency of enabling the linear light source and the sensor group, the beam intensity of the linear light source, and the sensitivity of the sensor group.

In an embodiment of the disclosure, the suction device further includes a remote control device to communicate wirelessly with the control host, receive and store at least one of status information of the suction device and feature information of the object, analyze at least one of the status information of the suction device and the feature information of the object, and issue a suction-force adjustment command to the control host based on an analysis result.

In an embodiment of the disclosure, the feature information of the object includes image data of the object, and the remote control device displays an image of the object according to the image data of the object.

The disclosure further provides a suction force adjustment method for a suction device including a suction unit and a suction pipe connected to the suction unit, and a suction force is provided in the suction pipe to suck an object. The suction force adjustment method for the suction device includes the following steps. At least one linear light source is provided, and the linear light source provides a light curtain formed by multiple beams. The light curtain is located on the suction path of the suction pipe, and the object passes through the light curtain along the suction path. At least one sensor group is provided. The linear light source and the sensor group are disposed on both sides of the suction path, and the sensor group senses the beams uninterrupted by the object to be tested to generate a sensing signal. Physical features of the object are determined according to the sensing signal. The suction force of the suction unit is regulated based on the physical features of the object.

In an embodiment of the disclosure, the suction force adjustment method of the suction device includes displaying an image of the object according to the sensing signal.

In an embodiment of the disclosure, the physical features of the object include at least one of transparency, quantity, density, shape, and size of the object.

In an embodiment of the disclosure, the beams are visible light or invisible light, and the sensor group includes a visible light sensor or an invisible light sensor.

In an embodiment of the disclosure, the suction force adjustment method of the suction device includes adjusting operating parameters of the linear light source and the sensor group according to the suction force of the suction unit.

In an embodiment of the disclosure, the operating parameters of the linear light source and the sensor group include the frequency of enabling the linear light source and the sensor group, the beam intensity of the linear light source, and the sensitivity of the sensor group.

In an embodiment of the disclosure, the suction force adjustment method of the suction device comprises: communicating wirelessly with a remote control device, transmitting at least one of status information of the suction device and feature information of the object to the remote control device, receiving a suction-force adjustment command from the remote control device, and adjusting the suction force of the suction unit according to the suction-force adjustment command.

In an embodiment of the disclosure, the feature information of the object includes image data of the object, and the remote control device displays an image of the object according to the image data of the object.

Based on the above, in the embodiments of the disclosure, an optical detection unit is disposed on the suction path of the suction pipe, so as to detect objects flowing through the suction pipe, determine the physical features of the object based on the sensing results of the optical detection unit, and regulate the suction force of the suction unit based on the physical features of the objects. In this way, the suction force of the suction device may be adjusted based on the physical features of the object to improve the suction efficiency of the suction device effectively.

DESCRIPTION OF THE EMBODIMENTS

Figure 1:
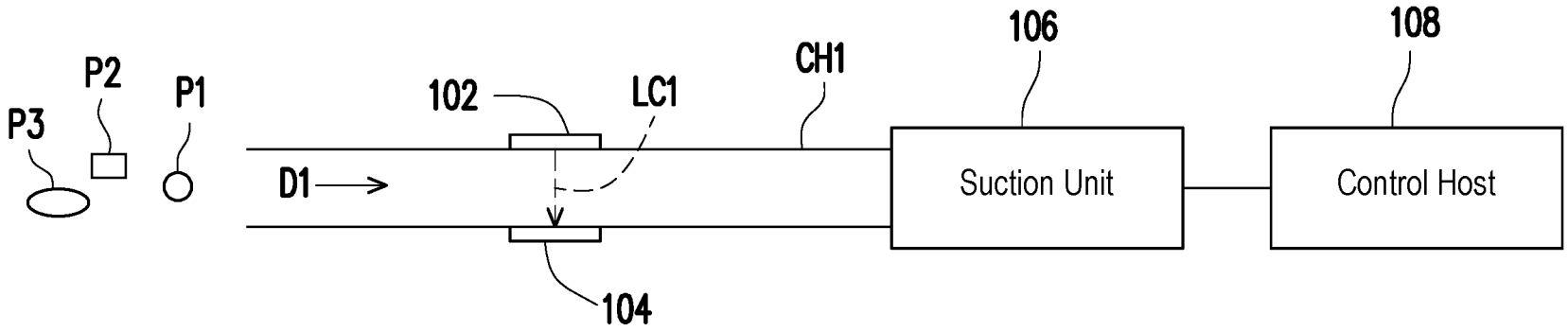
FIG. 1 is a schematic diagram of a suction device according to an embodiment of the disclosure.

FIG. 1 is a schematic diagram of a suction device according to an embodiment of the disclosure. The suction device may be, for example, a vacuum cleaner or a sweeping robot, but it is not limited thereto. The suction device includes a suction pipe CH1, an optical detection unit including a linear light source 102 and a sensor group 104, a suction unit 106, and a control host 108. The control host 108 is coupled to the linear light source 102, the sensor group 104, and the suction unit 106. The coupling relationship between the control host 108, the linear light source 102, and the sensor group 104 is omitted for the simplicity of the drawings. In addition, the suction unit 106 is also connected to the suction pipe CH1.

The suction unit 106 provides a suction force in the suction channel CH1 to suck objects, such as objects P1 to P3 in this embodiment. In the application scenario where the suction device is a vacuum cleaner, the objects P1 to P3 may be, for example, dust, paper scraps, hair, dander, and liquid, but the disclosure is not limited thereto. The suction unit 106 may be implemented by, for example, a fan motor, but the disclosure is not limited thereto. The optical detection unit is disposed on the suction path D1 of the suction pipe CH1 to detect the objects P1 to P3 flowing through the suction pipe CH1.

Figure 2:
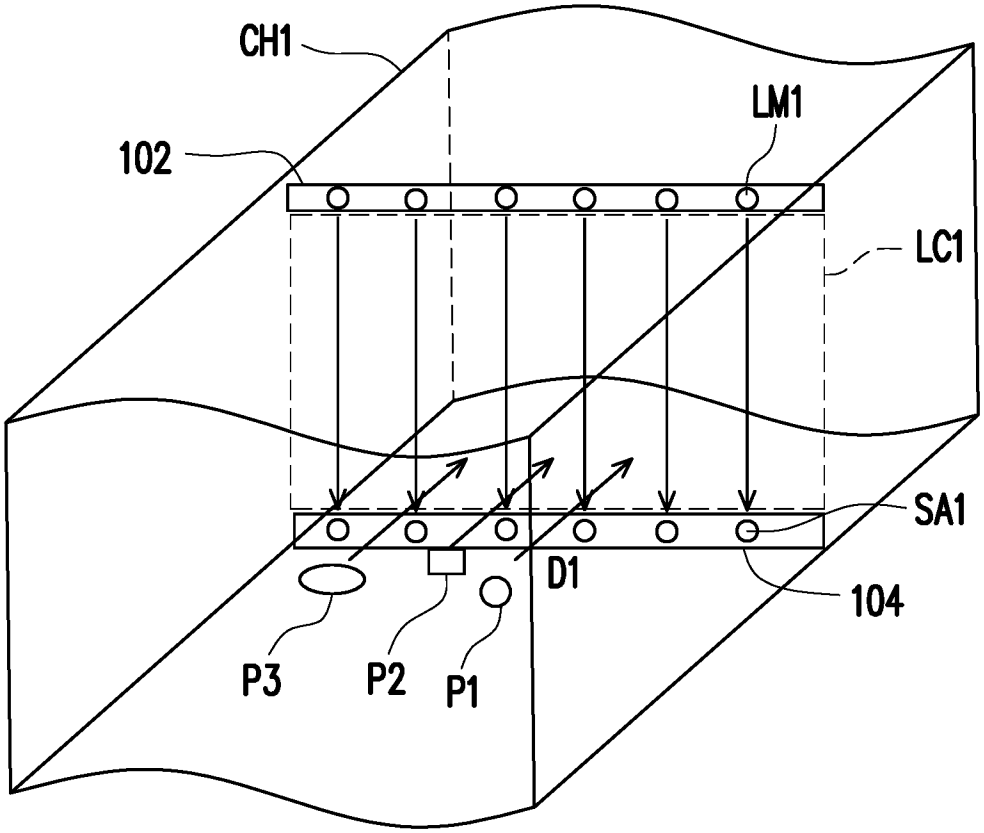
FIG. 2 is a schematic diagram of objects passing through a light curtain according to an embodiment of the disclosure.
Figure 3:
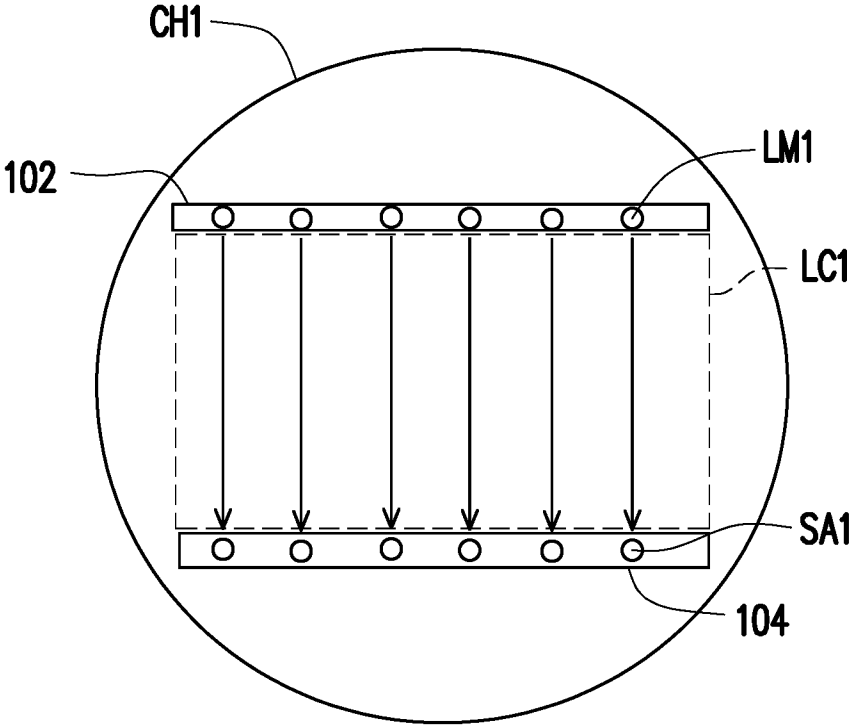
FIG. 3 is a schematic diagram of an optical detection unit disposed in a suction pipe according to an embodiment of the disclosure.

Furthermore, the linear light source 102 of the optical detection unit provides a light curtain LC1 formed by a plurality of beams (as shown by the dotted line). The light curtain LC1 is located on the suction path of the objects P1 to P3. The linear light source 102 and the sensor group 104 are disposed on both sides of the suction path D1. The linear light source 102 and the sensor group 104 are, for example, disposed on the suction pipe CH1 (as shown in FIG. 2). In some implementations, the linear light source 102 and the sensor group 104 may also be disposed in the suction pipe CH1 (as shown in FIG. 3), and the cross-sectional shape of the suction pipe CH1 is not limited to the rectangle shown in FIG. 2 or the circle shown in FIG. 3. The objects P1 to P3 pass through the light curtain LC1 while moving along the suction path D1 under the influence of the suction force (for example, the moving direction of the objects through the light curtain LC1 is perpendicular to the direction of the light curtain LC1, but the disclosure is not limited thereto; in other embodiments, the moving direction of the objects through the light curtain LC1 may form a specific angle less than 90 degrees with the normal of the light curtain LC1).

The linear light source 102 includes a plurality of light-emitting units LM1 as shown in FIG. 2. The light-emitting unit LM1 may be, for example, a light-emitting diode or a laser diode, but the disclosure is not limited thereto. And the light-emitting unit LM1 may be a visible light source or an invisible light source, such that the beams emitted by the linear light source 102 is visible light or invisible light. The light-emitting units LM1 may be disposed in a line. For example, in the embodiment of FIG. 2, the light-emitting units LM1 are disposed in a straight line, such that the linear light source 102 is a straight line. In some embodiments, the linear light source 102 may further include a light guide rod that homogenizes the beams emitted by the light-emitting unit LM1.

The sensor group 104 is disposed on the transmission path of the beams emitted by the linear light source 102. When the beams of the linear light source 102 are not blocked by the objects P1 to P3, the sensor group 104 receives the beams directly from the linear light source 102. Furthermore, the sensor group 104 includes at least one sensor unit SA1. For example, the sensor group 104 includes a plurality of sensor units SA1. The sensor units SA1 are disposed in a straight line at equal intervals corresponding to the linear light sources 102. The sensor group 104 is controlled by the control host 108 to sense periodically and continuously the beams emitted from the linear light source 102 uninterrupted by the objects P1 to P3, and correspondingly generate sensing signals for the control host 108.

The control host 108 determines the physical features of the objects P1 to P3 according to the sensing signals. The physical features of the objects P1 to P3 includes, for example, transparency, quantity, density, shape, size, thickness, etc. Therefore, the control host 108 determines the degree of dirtiness of the environment from the physical features, and regulates the suction force of the suction unit 106 based on the physical features (which indicate the degree of dirtiness of the environment) of the objects P1 to P3. For example, in response to larger or higher quantity, density, shape, size, and/or thickness of the objects P1 to P3 that indicate a higher degree of dirtiness of the environment, the control host 108 increases the suction force of the suction unit 106 to suck the objects P1 to P3; in contrast, in response to a smaller or lower quantity, density, shape, size, and/or thickness of the objects P1 to P3 that indicate a low degree of dirtiness of the environment, the control host 108 may reduce or remain the suction force of the suction unit 106 to suck the objects P1 to P3. In this way, the suction efficiency of the suction device may be improved effectively, and the power consumption may be reduced.

Additionally, in some embodiments, the control host 108 also determines the moving speeds of the objects P1 to P3 according to the sensing signals, and determines according to the moving speeds of the objects P1 to P3 whether the suction force of the suction unit 106 is reduced because it is worn out or other factors, and then according to the moving speeds of the objects P1 to P3 adjusts the suction force of the suction unit 106 to maintain the suction efficiency of the suction device. For example, when the moving speed of the objects P1 to P3 is lower than a preset value, the control host 108 enhances the suction force of the suction unit 106 to increase the moving speed of the objects P1 to P3 to thereby maintain the suction efficiency of the suction device. In addition, the control host 108 may also determine the characteristics of the objects P1 to P3 based on the physical features of the objects P1 to P3. For example, it is determined by the transparency and shape of the objects P1 to P3 whether the objects P1 to P3 are liquid or solid, and the suction force of the suction unit 106 is adjusted accordingly.

In addition, while the control host 108 adjusts the suction force of the suction unit 106, the control host 108 may also adjust the operating parameters of the linear light source 102 and the sensor group 104 according to the suction force of the suction unit 106. For example, when the control host 108 enhances the suction force of the suction unit 106 to increase the moving speeds of the objects P1 to P3, the control host 108 increases the beam intensity of the linear light source 102 and the frequency of enabling the linear light source 102 to emit light (that is, the quantity of the light curtains generated per unit time are increased), and correspondingly increases the sensitivity of the sensor group 104 and the frequency of receiving the beams to ensure that the detection quality of the optical detection unit is not degraded due to the adjustment of the suction force.

Figure 4:
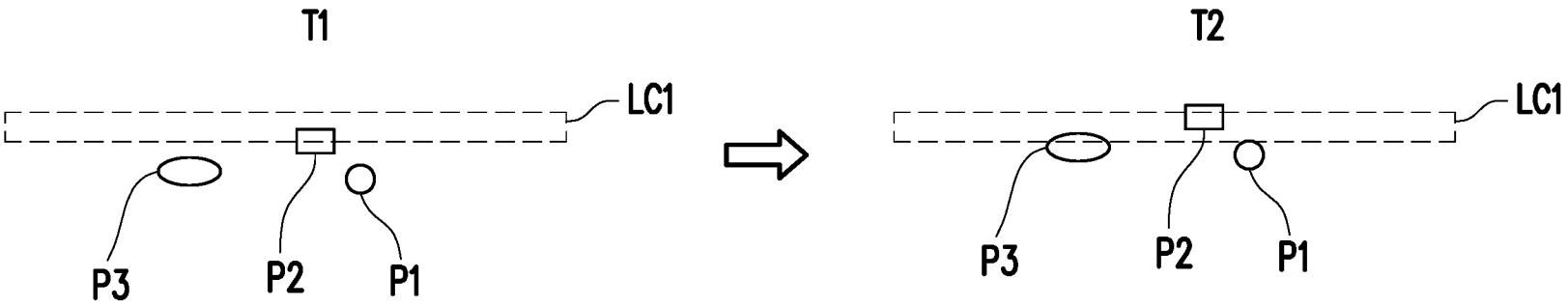
FIG. 4 and FIG. 5 are schematic diagrams of a linear light source according to an embodiment of the disclosure.

FIG. 4 shows how the optical detection unit may detect the object. For example, at time T1, part of the object P2 enters the sensing area (as indicated by the dotted line) formed by the light curtain LC1 on the transmission path, and as time elapses, the rest of the object P2 also gradually enter the light curtain LC1. For example, the rest of the object P2 has fully entered the light curtain LC1 at time T2. The control host 108 controls the sensor group 104 to sense continuously the part of the beams uninterrupted by the object at time T1 and T2 to generate a sensing signal, and determines the physical features and the moving speed of the object P2 according to the strength of the sensing signal. Similarly, the physical features and the moving speeds of the objects P1 and P3 may also be known in the same way. In some embodiments, the control host 108 also adjusts the sensitivity of the sensor group 104 based on the beam intensity of the linear light source 102 according to the sensing signal, or adjusts the beam intensity of the linear light source 102 according to the sensing signal, so as to achieve the best detection effect.

Furthermore, when the distances between the objects P1 to P3 passing through the light curtain LC1 and the sensor group 104 and the linear light source 102 are the same--for example, the distance between the objects P1 to P3 and the sensor group 104 is equal to the distance between the objects P1 to P3 and the linear light source 102--the intensity distribution of the sensing signals of the sensor group 104 may represent the light intensity distribution of the beams received by the sensor group 104, and the light intensity distribution of the beams reflects the transparency, quantity, density, shape, size, and thickness of the objects P1 to P3. For example, when the transparency of the objects P1 to P3 is lower, the thickness is thicker, or the height is higher, more beams are interrupted, which in turns weakens the intensity of the sensing signal. The control host 108 may control the sensor group 104 to sense periodically and continuously the beams uninterrupted by the objects P1 to P3 to generate a plurality of sets of sensing signals, and determine the range of the interrupted beams according to the sensing signals. The range where the beams are interrupted reflects the contours of the objects P1 to P3, and the quantity, density, shape, moving speed and size of the objects P1 to P3 may be known. In addition, when the objects P1 to P3 are the same object, the intensity of the sensing signal of the sensor group 104 reflects the distance between the objects P1 to P3 and the linear light source 102. For example, when the objects P1 to P3 are closer to the linear light source 102, the objects P1 to P3 block more beams provided by the linear light source 102, such that the distance between the objects P1 to P3 and the linear light source 102 may be known. Therefore, the control host 108 is able to determine information like transparency, quantity, density, shape, size, moving speed, and thickness of the objects P1 to P3 according to the sensing signals.

Figure 5:
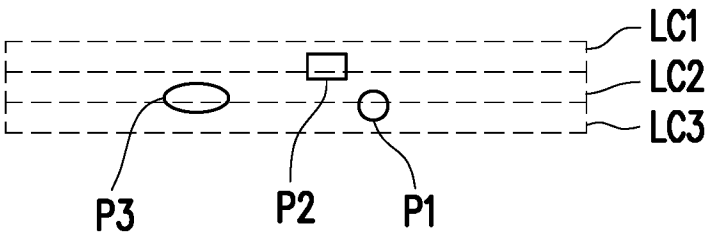

In some embodiments, the quantity of the linear light source 102 and the sensor group 104 is not limited to one. For example, in the embodiment of FIG. 5, the optical detection unit includes three side-by-side linear light sources 102 and corresponding three sensor groups 104. Similar to the embodiments above, the three side-by-side linear light sources 102 and the corresponding three sensor groups 104 are also disposed on both sides of the suction path D1, and thus the same description is omitted here. The three linear light sources 102 provide three light curtains LC1, LC2, and LC3. The light curtains LC1, LC2, and LC3 form sensing regions on the suction paths of the objects P1 to P3. The control host 108 receives the sensing signals from the three sensor groups 104 at the same time, and learn simultaneously the physical features and the moving speeds of the objects P1 to P3 according to the sensing signals from the three sensor groups 104.

Figure 6:
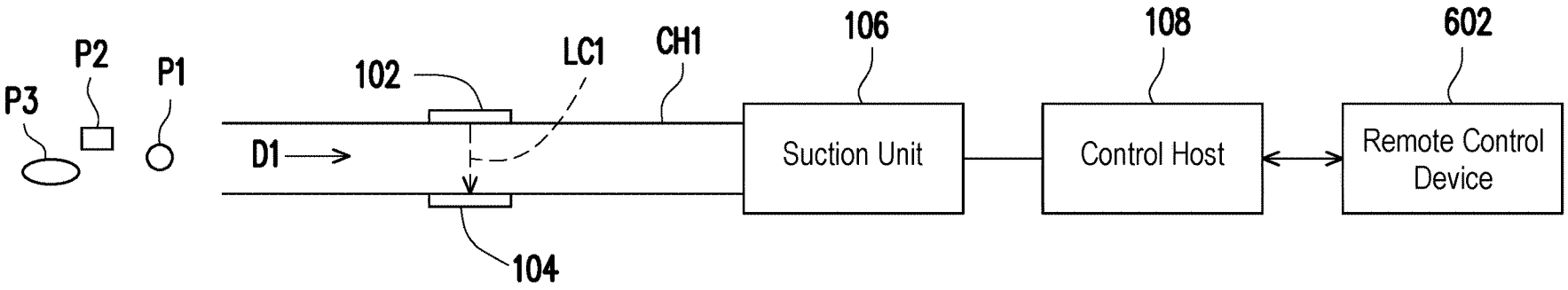
FIG. 6 is a schematic diagram of a suction device according to another embodiment of the disclosure.

FIG. 6 is a schematic diagram of a suction device according to another embodiment of the disclosure. In this embodiment, the control host 108 may also display the images of the objects P1 to P3 according to the sensing signals of the sensor group 104, such that the user can know directly what the objects P1 to P3 are, and it is convenient for the user to control the suction force of the suction device accordingly. In addition, the suction device of this embodiment may further include a remote control device 602 (such as a portable electronic device such as a mobile phone and a watch, but it is not limited thereto), and the control host 108 may communicate with the remote control device 602 to transmit at least one of the status information of the suction device (such as the suction force of the suction unit 106 and the moving speed of the objects P1 to P3) and the feature information of the objects P1 to P3 (such as the physical features of the objects P1 to P3 and the image data of the objects P1 to P3) to the remote control device 602. The remote control device 602 may analyze the information sent from the control host 108, and transmit a suction-force adjustment command to the control host 108 based on the analysis result, such that the control host 108 is able to adjust the suction force of the suction unit 106 according to the suction-force adjustment command. For example, the remote control device 602 analyzes the status information of the suction device to obtain the operating status of the suction device (such as its suction efficiency and power consumption, but it is not limited thereto), analyzes the feature information of the objects P1 to P3 to obtain the components of the objects P1 to P3 (such as dust, sand, hair, etc., but it is not limited thereto), and sends a suction-force adjustment command to the control host 108 based on the analysis result, such that the control host 108 may adjust the suction force of the suction unit 106 according to a specific mode (such as an energy saving mode or a strong suction mode), such that the suction device is able to suck the objects P1 to P3 in a more energy-saving or efficient way. In addition, the remote control device 602 may also display images according to the image data of the objects P1 to P3, such that the user is allowed to judge the composition of the objects P1 to P3 based on the images of the objects P1 to P3 and operate the remote control device 602 according to its requirements to issue the corresponding suction-force adjustment command to the control host 108, such that the control host 108 may adjust the suction force of the suction unit 106 according to the suction-force adjustment command.

Figure 7:
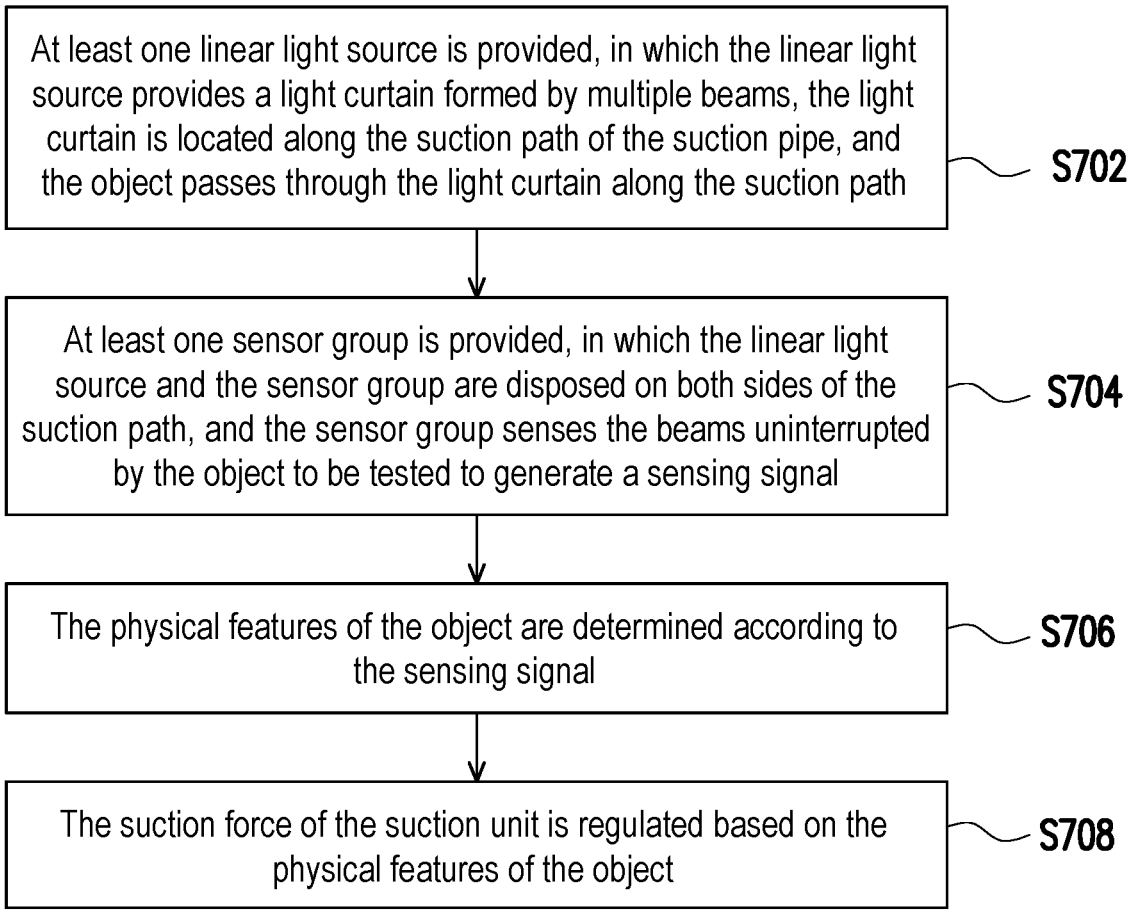
FIG. 7 is a flowchart of a suction force adjustment method for a suction device according to an embodiment of the disclosure.

FIG. 7 is a flowchart of a suction force adjustment method for a suction device according to an embodiment of the disclosure. It may be known from the above embodiments that the suction force adjustment method for the suction device at least includes the following steps. First, at least one linear light source is provided, in which the linear light source provides a light curtain formed by multiple beams, the light curtain is located along the suction path of the suction pipe, and the object passes through the light curtain along the suction path (step S702). The linear light source includes a plurality of light-emitting units. Next, at least one sensor group is provided, in which the linear light source and the sensor group are disposed on both sides of the suction path, and the sensor group senses the beams uninterrupted by the object to be tested to generate a sensing signal (step S704). The beams are visible light or invisible light, and the sensor group is correspondingly visible light sensor or invisible light sensor. For example, the sensor group may be controlled to sense periodically and continuously the part of the beams uninterrupted by the object to be tested to generate the sensing signal. Then, the physical features of the object are determined according to the sensing signal (step S706). The physical features of the object include at least one of transparency, quantity, density, shape, and size of the object, but the disclosure is not limited thereto. Finally, the suction force of the suction unit is regulated based on the physical features of the object (step S708).

Figure 8:
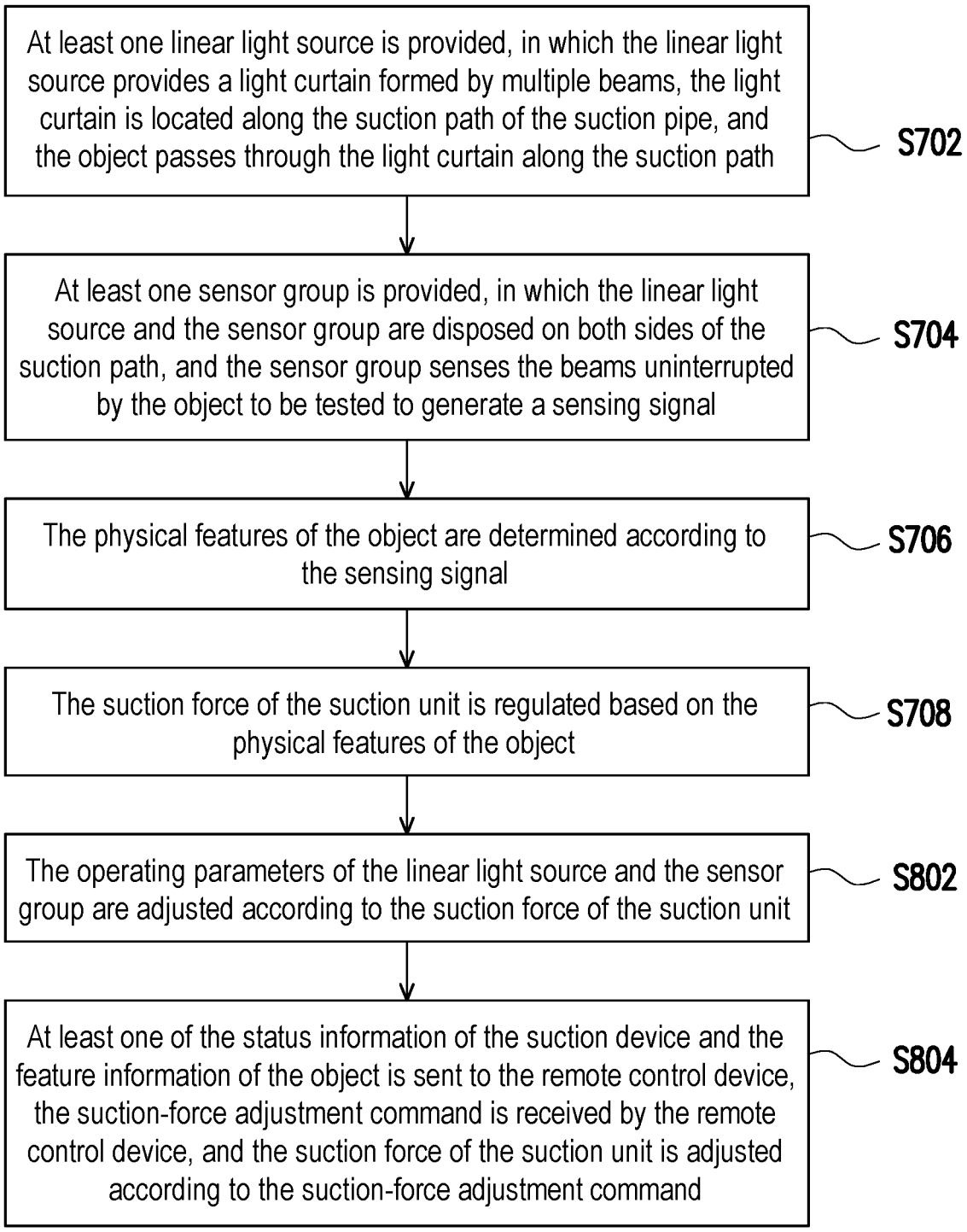
FIG. 8 is a flowchart of a suction force adjustment method for a suction device according to another embodiment of the disclosure.

FIG. 8 is a flowchart of a suction force adjustment method for a suction device according to another embodiment of the disclosure. In this embodiment, the suction force adjustment method for the suction device may further include a step 5802 and a step 5804. In step 5802, the operating parameters of the linear light source and the sensor group are adjusted according to the suction force of the suction unit. For example, the beam intensity of the linear light source and the frequency of enabling the linear light source to emit light are adjusted, and the sensitivity of the sensor group 104 and the frequency of receiving the beams are adjusted accordingly to ensure that the detection quality of the optical detection unit is not affected by the adjustment of the suction force. In addition, in some embodiments, in step 5802, the image of the object may also be displayed according to the sensing signal to facilitate the user to know the composition of the object directly. In step 5804, at least one of the status information of the suction device and the feature information of the object is sent to the remote control device, the suction-force adjustment command is received by the remote control device, and the suction force of the suction unit is adjusted according to the suction-force adjustment command, such that the user at a distance is also allowed to know the working status of the suction device, and the suction-force adjustment command from the remote control device may be received to adjust the suction force of the suction device accordingly, such that the suction force of the suction device is able to meet the needs of the user. In some embodiments, the feature information of the object includes image data of the object, and the remote control device may display the image of the object according to the image data of the object, such that the remote user is able to know the object composition the through the image of the object.

To sum up, in the embodiment of the disclosure, an optical detection unit is disposed on the suction path of the suction pipe, so as to detect the object flowing through the suction pipe, determine the physical features of the object based on the sensing results of the optical detection unit, and regulate the suction force of the suction unit based on the physical features of the object, such that the suction force of the suction device may be adjusted based on the physical features of the object to improve the suction efficiency of the suction device effectively. In some embodiments, at least one of the status information of the suction device and the feature information of the object is also transmitted to the remote control device, such that the remote user is also able to know the working status of the suction device. In addition, the suction device may also receive a suction-force adjustment command from the remote control device and adjust the suction force accordingly, thereby improving the convenience of the suction device for the users.

What is claimed is:

1. A suction device, comprising:

a suction pipe;

a suction unit connected to the suction pipe to provide a suction force in the suction pipe to suck an object;

an optical detection unit disposed on a suction path of the suction pipe to detect the object flowing through the suction pipe, the optical detection unit comprising:

at least one linear light source adapted to provide a light curtain formed by a plurality of beams, wherein the light curtain is located on the suction path, and the object passes through the light curtain along the suction path; and at least one sensor group, wherein the at least one linear light source and the at least one sensor group are disposed on both sides of the suction path, the sensor group senses the beams uninterrupted by the object to generate a sensing signal, each sensor group includes a plurality of sensor units disposed at equal intervals corresponding to the at least one linear light source, and the plurality of sensor units periodically and continuously sense the beams that are not interrupted by the object and generate an intensity distribution of a plurality of sets of sensing signals; and a control host coupled to the suction unit, the at least one linear light source, and the at least one sensor group and adapted to determine physical features of the object according to an image composed of the intensity distribution of the plurality of sets of the sensing signals and regulate the suction force of the suction unit by driving a motor of the suction unit based on the physical features of the object, the control host further adjusts operating parameters of the at least one linear light source and the sensor group according to the suction force of the suction unit.

2. The suction device of claim 1, wherein the control host further displays an image of the object according to the sensing signal.

3. The suction device of claim 1, wherein the physical features of the object comprise at least one of transparency, quantity, density, shape, and size of the object.

4. The suction device of claim 1, wherein the beams are visible light or invisible light, and the at least one sensor group comprises a visible light sensor or an invisible light sensor.

5. The suction device of claim 1, wherein the operating parameters of the at least one linear light source and the at least one sensor group comprise a frequency of enabling the at least one linear light source and the at least one sensor group, a beam intensity of the at least one linear light source, and a sensitivity of the at least one sensor group.

6. The suction device of claim 1, further comprising:

a remote control device adapted to communicate with the control host wirelessly, receive and store at least one of status information of the suction device and feature information of the object, analyze the at least one of the status information of the suction device and the feature information of the object, and issue a suction-force adjustment command to the control host based on an analysis result.

7. The suction device of claim 6, wherein the feature information of the object comprises image data of the object, and the remote control device displays an image of the object according to the image data of the object.

* * * * *